United States Patent [19]

Purslow et al.

[11] Patent Number: 4,908,961

[45] Date of Patent: Mar. 20, 1990

[54] FLEXIBLE SHOE WITH SECTIONED INSOLE

[75] Inventors: Terence A. Purslow, Northampton; Donald W. J. Green, Kettering, both of Great Britain

[73] Assignee: William Green and Son Limited, Northamptonshire, United Kingdom

[21] Appl. No.: 310,512

[22] Filed: Feb. 14, 1989

Related U.S. Application Data

[63] Continuation of Ser. No. 7,845, Jan. 28, 1987, abandoned.

[30] Foreign Application Priority Data

Jan. 28, 1986 [GB] United Kingdom ..... 8601973

[51] Int. Cl.[4] ..... A43B 13/39; A43B 13/40; A43B 13/16

[52] U.S. Cl. ..... 36/22 A; 36/31; 36/43

[58] Field of Search ..... 36/43, 44, 22 R, 22 A, 36/31, 30 A

[56] References Cited

U.S. PATENT DOCUMENTS

| | | | |
|---|---|---|---|
| 672,651 | 4/1901 | Ries | 36/22 R |
| 849,245 | 4/1907 | Johnson | 36/43 X |
| 1,767,698 | 6/1930 | Pickett | 36/43 X |
| 1,927,421 | 9/1933 | Sewall | 36/43 |
| 2,074,121 | 3/1937 | Goodyear | 36/22 R |
| 2,185,993 | 1/1940 | Haskell | 36/43 X |
| 2,274,205 | 2/1942 | Mann | 36/43 |
| 2,598,296 | 5/1952 | Pierson | 36/22 A |
| 2,691,227 | 10/1954 | Sachs | 36/43 X |
| 2,746,176 | 5/1956 | Maccarone | 36/22 R |
| 3,252,231 | 5/1966 | Gilkerson | 36/30 A |
| 3,497,892 | 3/1970 | Parrelli | 36/43 |

FOREIGN PATENT DOCUMENTS

| | | | |
|---|---|---|---|
| 12516 | 9/1909 | Denmark | 36/44 |
| 418837 | 9/1925 | Fed. Rep. of Germany | 36/43 |
| 16509 | of 1898 | United Kingdom | 139/384 R |
| 611344 | 10/1948 | United Kingdom | 36/44 |

*Primary Examiner*—James Kee Chi

*Attorney, Agent, or Firm*—Norman S. Blodgett; Gerry A. Blodgett

[57] ABSTRACT

An insole is provided for a shoe, particularly for a welted shoe which insole is composed of at least three longitudinally arranged sections, adjacent sections being connected at transverse lines of flexure to impart a degree of flexibility to the insole. Preferably the transverse lines of flexure are produced by sewing together three separate sections forming respectively a toe section a center section and a waist section of alternate methods of producing transverse lines of flexure are suggested. The invention also provides a welted shoe incorporating such an insole, said shoe according to a preferred embodiment being provided with such an insole having a projecting rib to which the shoe upper a lining for the shoe upper (if present) and a welt are affixed, in which shoe, before application of the sole of the shoe, the rib and that portion of the upper adjacent the rib are deformed inwardly so as to lie adjacent to the lower surface of the insole.

12 Claims, 2 Drawing Sheets

FLEXIBLE SHOE WITH SECTIONED INSOLE

This is a continuation of co-pending application Ser. No. 07/007,845 filed on Jan. 28, 1987.

This invention relates to improvements in or relating to footwear and relates in particular to an insole for a shoe (particularly a welted shoe) and to a shoe incorporation such an insole. In all that follows "insole" is used in the British sense to - denote the sturdy central element in shoe construction made of materials that are capable of taking stiching, nails, and like fastening means, and of acting as the basis for shoe construction to which other elements of the shoe are attached. This is to distinguish from the American usage of the word which also includes lightweight elements (which are known as "insocks" in Britain) which are inserted or lightly attached inside a shoe after construction.

In a traditional welted shoe the insole is formed from a single piece of thick leather. Fixed to the bottom of the insole is a protecting rib to which the upper and the welt are sewn.

The thickness of the insole and the nature of the material from which it is fashioned, together with the presence of the projecting rib, mean that the insole is extremely rigid and does not feel at all soft to the foot of a wearer. Traditionally such shoes need "breaking in" by the wearer before any degree of comfort can be achieved.

The present invention has as an object the alleviation of the problems inherent in such a traditional insole.

According to the present invention there is provided an insole for a shoe, particularly for a welted shoe, which insole is composed of at least three longitudinally arranged sections, adjacent sections being connected at transverse lines of flexure to impart a degree of flexibility to the insole.

Preferably the transverse lines of flexure are produced by sewing together, e.g. by means of a zig zag stich, three separate sections forming respectively a toe section, a centre section and a waist section. Although it is envisaged that the insole may be made of any suitable natural or synthetic material it is preferred that leather be employed for this purpose and that a different leather be employed for the centre section from that employed for the toe and waist sections. For example, the toe and waist sections may be formed from the conventional leather used to make traditional insoles, e.g. vegetable tanned shoulder leather of four irons in thickness (0.21 cms), whilst the center section is preferably made from a full chrome crust upper material also of four irons in thickness (0.21 cms).

As alternatives to the connection of separate sections, e.g. by stitching or by means of a cloth hinge, it is envisaged that the sections could be formed from a single sheet of material provided with transverse regions of thinning to form the said lines of flexure. Alternatively the three sections may be different sections adhered together at their junctions in such a way as to provide the said lines of flexure. It is envisaged for example that contiguous edges of the respective sections could be provided with cooperating tapers, the tapered surfaces being glued to each other.

According to a further aspect of the present invention there is provided a welted shoe incorporating an insole as hereinbefore defined. Although the provision of the sectioned insole provides a degree of flexibility and although the comfort of the shoe may be augmented by the use of a relatively soft centre section for the insole, the existence of the rib projecting from the insole still acts to reduce the ultimate flexibility of the insole and hence of a shoe into which it is incorporated.

According to a further aspect of the present invention therefore there is provided a welted shoe having an insole as hereinbefore defined provided with a projecting rib to which a shoe upper, a lining for a shoe upper is present and a welt affixed, in which shoe, before application of the sole of the shoe, the rib and that portion of the upper adjacent the rib are deformed inwardly so as to lie adjacent to the lower surface of the insole. By such a deformation the insole is rendered yet more flexible.

The cavity defined between the lower surface of the insole and the so deformed rib surrounding the insole will generally be filled with a packing material. This may be a conventional packing material such as leather or a cork-based material such as rubberized cork but it is preferably a resilient cellular material such as a foamed rubber or plastics. The presence of such a resilient cellular packing material serves to further increase the comfort of the shoe when worn.

An embodiment of the present invention will now be described, by reference to the accompanying drawings, in which:

FIG. 3 shows one means of imparting additional flexibility

FIG. 4 shows another means of imparting additional flexibility, and

FIG. 5 shows an aspect of the present invention when applied to a welted shoe construction.

Figure 1:
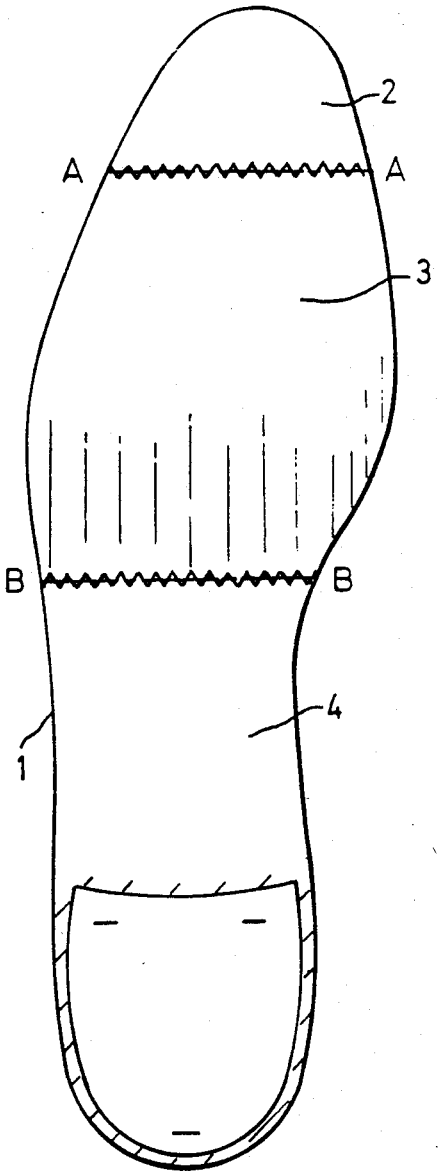
FIG. 1 is a plan of an embodiment of an insole according to the present invention.
Figure 2:
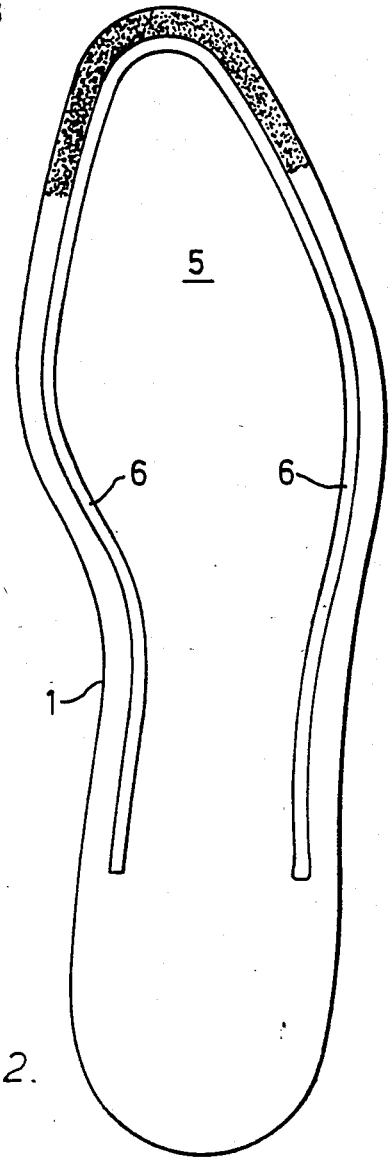
FIG. 2 shows the underside of a completed shoe.

Referring to FIGS. 1 and 2, an insole 1 consists of a toe section 2, a centre 3 and a waist or seat section 4. Toe section 1 and waist section 4 are produced from vegetable tanned bare shoulder leather of 4 irons thick (0.21 cms) whilst centre section 3 is produced from full chrome crust upper material of the same thickness. The centre section 3 is attached at A—A and B—B to the toe section 2 and the waist section 4 by means of zig-zag stitching or seaming. The resultant insole is therefore able to flex along lines A—A and B—B to increase the comfort of the shoe whilst the fact that the centre section is composed of a softer leather than the toe and waist sections further increases the comfort of the shoe to a wearer.

FIGS. 3 and 4 illustrate two alternative structures adapted to produce the transverse lines of flexure. The figures show the connection of the toe section 2 to the centre section 3 at A by providing a thinned section (FIG. 3) or cooperating, tapered surfaces, glued together (FIG. 4.)

On the underside 5 of insole 1 is provided a projecting rib 6, which rib is inset from the rib of the insole 1 by an amount of 9/32" at waist and toe sections and 7/32" centre section 3.

A leather upper 9 as shown in FIG. 5, is attached to the projecting rib 6 and thereafter a welt 10 is likewise attached to the rib 6. Thereafter the rib 6 with adjacent attached portions of the upper and the welt is hammered inwardly to lie flat adjacent the underside 5 of the insole 1. By such flattening, the resistance to flexing afforded to the insole by the projecting rib is reduced.

The cavity 7 defined between insole 1 and deformed rib 6 is filled with foamed rubber or plastics material 11, thereby further to increase the comfort of the shoe to a wearer.

The insole and shoe of the present invention afford a shoe which possesses the advantages of a traditional shoe but with the additional advantage of greatly increased flexibility and comfort.

We claim:

1. An insole made from material capable of accepting stitching, nails, and like fastening means and thus of acting as a construction basis for a welted shoe, which insole is composed of at least three longitudinally arranged sections, each section being substantially flexible, each section having a respective degree of flexibility, adjacent sections being connected in a hinged manner at transverse lines of flexure to impart an additional degree of flexibility to the insole near each line of flexure, wherein a projecting rib for attachment to a shoe upper and welt is cemented thereto so as to overlap each of the lines of flexure.

2. An insole according to claim 1, wherein the transverse lines of flexure are produced by sewing together three separate sections, forming respectively a toe section, a center section, and a waist section.

3. An insole according to claim 2, wherein said three separated sections are sewn together by means of a zig-zag stitch.

4. An insole according to claim 1, wherein the sections are composed of leather.

5. An insole according to claim 2, wherein said toe and waist sections are composed of vegetable-tanned shoulder leather and said center section is composed of full chrome crust upper leather.

6. An insole according to claim 1, wherein said transverse lines of flexure are formed by providing transverse regions of thinning in a single sheet of material.

7. An insole according to claim 1, wherein the three longitudinally arranged separated sections are provided at their contiguous edges with co-operating tapered surfaces, the tapered surfaces being glued to each other to provide said transverse lines of flexure.

8. A welted shoe incorporating an insole as recited in claim 1.

9. A shoe according to claim 8, wherein, before application of the sole, the rib and that portion of the upper adjacent to the rib are deformed inwardly so as to lie adjacent to the lower surface of the insole.

10. A shoe according to claim 9, wherein a cavity is defined between a lower surface of the insole and said deformed rib surrounding the insole and wherein said cavity is filled with a packing material.

11. A shoe according to claim 10, wherein said packing material is a resilient cellular material.

12. A shoe according to claim 11, wherein said resilient cellular material is a foamed rubber or plastic material.

* * * * *